United States Patent [19]

Wakita et al.

[11] 4,346,686

[45] Aug. 31, 1982

[54] IDLE CONTROLLER FOR AN INTERNAL COMBUSTION ENGINE

[75] Inventors: Nobuaki Wakita; Hiroshi Kanai, both of Susono, Japan

[73] Assignee: Toyota Jidosha Kogyo Kabushiki Kaisha, Toyota, Japan

[21] Appl. No.: 146,440

[22] Filed: May 5, 1980

Related U.S. Application Data

[63] Continuation of Ser. No. 919,172, Jun. 26, 1978, abandoned.

[30] Foreign Application Priority Data

Feb. 17, 1978 [JP] Japan ..... 53-17179

[51] Int. Cl.[3] ..... F02M 3/06; F02P 5/10

[52] U.S. Cl. ..... 123/339; 123/407; 123/389; 62/323.1; 237/12.3 R

[58] Field of Search ..... 123/339, 407, 408, 389, 123/328, 329, DIG. 11; 62/323.1; 237/12.3 R

[56] References Cited

U.S. PATENT DOCUMENTS

| | | | |
|---|---|---|---|
| 3,341,081 | 9/1967 | King | 222/146 |
| 3,556,064 | 1/1971 | Date et al. | 123/407 |
| 3,783,846 | 1/1974 | Barnhart et al. | 123/407 |
| 3,888,221 | 6/1975 | Stacey, Jr. | 123/408 |
| 4,005,693 | 2/1977 | Masaki et al. | 123/552 |
| 4,051,823 | 10/1977 | Mogi et al. | 123/407 |
| 4,060,063 | 11/1977 | Hirasawa | 123/328 |
| 4,128,087 | 12/1978 | Hayashi et al. | 123/DIG. 11 |
| 4,151,818 | 5/1979 | Tateno | 123/408 |

FOREIGN PATENT DOCUMENTS

| | | | |
|---|---|---|---|
| 1255467 | 12/1971 | United Kingdom | 123/407 |

*Primary Examiner*—Charles J. Myhre
*Assistant Examiner*—Andrew M. Dolinar
*Attorney, Agent, or Firm*—Finnegan, Henderson, Farabow, Garrett & Dunner

[57] ABSTRACT

An idle controller for an internal combustion engine which increases the idle setting of the engine and retards the idling timing whenever the heater is operated, so that in a particular embodiment in a vehicle which further includes an air conditioner the idle controller increases the idle opening of the throttle valve whenever either the heater or the air conditioner is operated, and retards the timing when the heater is operated.

3 Claims, 1 Drawing Figure

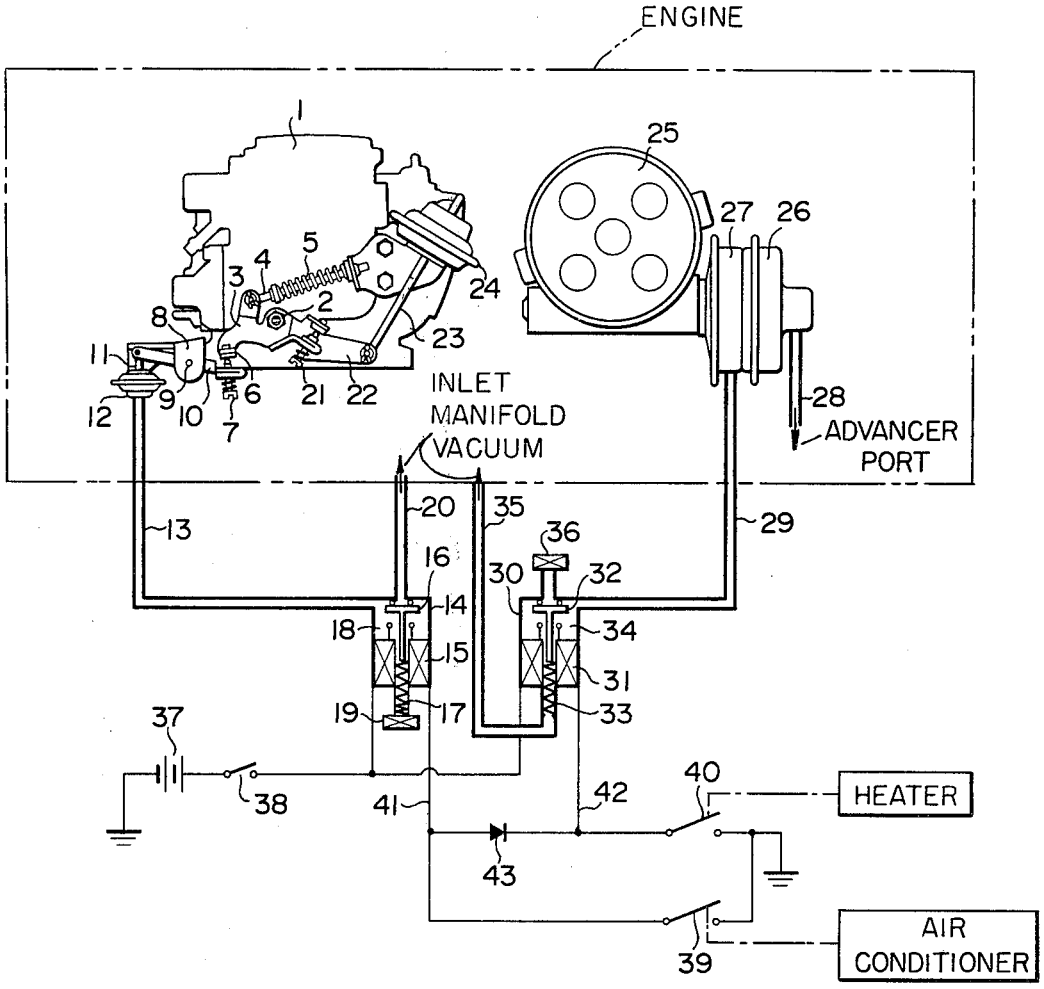
ENGINE
INLET
MANIFOLD
VACUUM
ADVANCER
PORT
HEATER
AIR
CONDITIONER

IDLE CONTROLLER FOR AN INTERNAL COMBUSTION ENGINE

This is a continuation of application Ser. No. 919,172, filed June 26, 1978, abandoned.

BACKGROUND OF THE INVENTION

The present invention relates to an internal combustion engine, and in particular is concerned with an improvement relating to the running under idling condition of an internal combustion engine in an automobile or other vehicle which is equipped with a heater and optionally with an air conditioner.

In order to minimize fuel consumption during idling, and also in order to minimze emissions of harmful exhaust gas components, the idling speed of an internal combustion engine is preferably set as low as possible consistent with stable rotation of the engine. That is, if the idling rotational speed is set too low, it will tend to fluctuate, and the engine will have a tendency to stall. If, on the other hand, the idling speed is set too high, fuel consumption and emissions of harmful exhaust gas components will be higher than necessary. Also problems will arise with the transmission, such that, if the vehicle is equipped with an automatic transmission, substantial "creep" will occur, making the vehicle difficult to control, and also leading to wear and premature failure of the transmission; whereas if the vehicle is equipped with a manual transmission, difficulty may well be experienced in getting the vehicle into gear from the neutral gearbox condition, and severe wear and possible premature failure of both the friction engaging means of the clutch system and of the synchromesh components of the gearbox may well occur.

When a vehicle is equipped with an air conditioner, the idling speed needs to be set somewhat higher when the air conditioner is operating than when it is not operating, since the conditioner imposes a substantial torque load on the engine. If the engine idling setting is not increased, the rotational speed of the engine will drop, and become unstable and liable to fluctuate, as described above, and the engine will tend to stall. When the engine idling setting is increased when the air conditioner is operating, more power is developed by the engine and is available for operating the air conditioner. Therefore, it has been the practice, in cars equipped with air conditioners, to incorporate an "idle-up" mechanism to increase the idling setting of the engine when the air conditioner is switched on.

On the other hand, in the case of a vehicle equipped with a heater which uses heat in the cooling water of the engine to heat the interior of the passenger compartment, the heater itself does not impose a torque load on the engine directly when it is functioning, since the heat is obtained from the cooling water of the engine, and the power required to blow air past the vanes of the heater is obtained either via an electric motor from the battery of the engine or from merely diverting a portion of the airstream which is in any event being propelled by the rotation of the engine fan.

However, a problem can occur when the heater of a car is operated while the vehicle is idling at the curbside. In these circumstances the heater often fails to work properly. The reason for this is that if the engine idle setting is as low as possible consistent with stable running, little heat will be generated in the engine and the temperature of the cooling water will fall, and, therefore, the heater will function at reduced efficiency.

In view of the aforementioned problem with regard to the operation of a heater in a vehicle, it has been envisaged in a co-pending U.S. patent application, Ser. No. 919,214, now abandoned, assigned to the same assignee as the present application, to provide, in a vehicle equipped with a heater, a mechanism which increases the idling setting of the engine when the heater is being operated, so as to consume more fuel and, therefore, to deliver more heat to the engine cooling water, thereby causing the heater to run warmer and more effectively.

Further, in the case of a vehicle which is equipped with both an air conditioner and a heater, it has in the aforementioned co-pending application been envisaged to use the same idling speed increasing mechanism to increase the idling speed either when the heater is being operated or when the air conditioner is being operated, since in both cases "idle-up" is desired, although for different reasons.

However, the increase of idling speed when the heater is operating, in an automobile equipped with the idling speed increasing mechanism above outlined, is rather greater than the increase of the idling speed when the air conditioner is operating, for the reason that the heater imposes no additional torque load on the engine, whereas the air conditioner, when operating, imposes a considerable torque load on the engine, and thus diminishes its idling rotational speed. When the heater is functioning, therefore, and the "idle-up" device is operating, an undesirably high increase in idling engine revolutions will occur, if the setting of the "idle-up" device is determined so as to provide the most desirable increase of idling speed when the air conditioner is being operated, and this in practice has been found to have disadvantages, such as outlined above, concerning "creep" in vehicles equipped with automatic transmissions, and concerning shifting the vehicle into gear from the gearbox neutral position, in vehicles equipped with manual transmissions and friction engaging means.

Therefore, in this case it appeared to be a desirable object to arrange some way of restraining this increase in engine idling speed, while still keeping the throttle of the automobile slightly opened in idling condition via the operation of the "idle-up" device, while the heater was functioning, in order to increase consumption of fuel and to supply more heat to the engine cooling water.

SUMMARY OF THE INVENTION

The present invention, therefore, provides, in a vehicle equipped with at least a heater, a system for controlling the idling setting and the ignition timing setting during idling condition of an internal combustion engine fitted to the vehicle between a high and a low setting and a more-advanced and a less-advanced setting, respectively, comprising a first means for controlling the idling setting of the engine between a high and a low setting, a second means for detecting operation of the heater, and a third means for controlling the ignition timing setting during idling condition of the engine between a more-advanced and a less-advanced setting, said first means and said third means being actuated when the heater is operating by said second means so as, to control the idling setting of the engine to be on high and the ignition setting during idling condition to be on the less-advanced setting.

Further, the present invention in another aspect provides, in a vehicle equipped with both a heater and an air conditioner, a system for controlling the idling setting and the ignition timer setting during idling condition of the engine, further comprising a fourth means for detecting operation of the air conditioner, said fourth means also controlling said first means so as to control the idling setting to be on high when the air conditioner is operating.

BRIEF DESCRIPTION OF THE DRAWING

The present invention will now be described in more detail with reference to a preferred embodiment, and with reference to the accompanying drawing. It should, however, be clearly understood that the embodiment and the drawing are for illustrative purposes and are not intended to limit the scope of the present invention, which scope is intended to be defined solely by the claims. In the drawing is shown in a rather diagrammatic form a sketch of the carburetor of a vehicle engine which is equipped with the "idle-up" device of the present invention, a first control valve for the "idle-up," the distributor of the vehicle engine, which has two vacuum advance means fitted to it, a second control valve for one of the vacuum advance means, and an electric circuit for controlling these two control valves.

DESCRIPTION OF THE PREFERRED EMBODIMENT

In the drawing, 1 designates generally a carburetor attached to an internal combustion engine which is not shown. 2 designates the primary throttle valve shaft, and this is rotated by a primary throttle valve operating mechanism which is not shown in the drawing but is located as positioned behind the carburetor 1 in the diagram. When the primary throttle valve shaft 2 is rotated in the clockwise direction in the diagram the primary throttle is turned from the closed towards the open position. A link 3 is firmly coupled to the shaft 2. The link 3 is pivotally connected to a rod 4 which passes through a hole on a bracket which is attached to the carburetor 1. Over the rod 4 is located a compression coil spring 5, which therefore acts to bias the link 3 and the shaft 2 in the anti-clockwise direction so as to close the primary throttle valve. Another portion of the link 3 is formed into a lug seat 6 which receives the tip of the idle-up adjustment screw 7 so as to function as a stop for the anti-clockwise rotation of the link 3 and the shaft 2. This idle-up screw 7 is carried by one end of a link member 10 which is pivoted on a pin 9 attached to a bracket 8 which is fixed to the carburetor 1. The other end of the link 10 is connected, via a rod 11, to the diaphragm of a diaphragm means 12. The diaphragm and the diaphragm chamber of the diaphragm means 12 are not specifically shown in the diagram in the interests of brevity of explanation, but the diaphragm chamber is located below the diaphragm in the drawing and is so adapted that when reduced pressure is fed to the diaphragm chamber the diaphragm moves downward in the drawing and pulls the rod 11 downward in the drawing, thereby raising the screw 7 and increasing the idling speed of the engine. The diaphragmn chamber of the diaphragm means 12 is connected to a vacuum pipe 13 which leads to a valve 14. The valve 14 is an electromagnetic vacuum switching valve and is adapted to switch the pipe 13 so as to be connected either to inlet manifold vacuum or to atmosphere, according as to whether current is supplied or is not supplied to the solenoid 15.

In more detail, this electromagnetic switching valve 14 comprises a solenoid 15, a valve element 16, a compression coil spring 17, a valve chamber 18, and an air filter 19, and is connected to a pipe 20 which is connected to a low pressure source, conveniently the inlet manifold. When current is not supplied to the solenoid 15, the valve element 16 is urged upwards under the effect of the compression coil spring 17, as shown in the diagram. Thereby atmospheric pressure, which passes through the air filter 19, is allowed to enter the valve chamber 18 and to enter the pipe 13, while on the other hand the inlet manifold vacuum which is supplied to the pipe 20 is intercepted by the valve element 16 and is not allowed to communicate with the pipe 13. If, however, current is supplied to the solenoid 15, then the valve element 16 is pulled downward in the figure against the urging force of the compression coil spring 17, and communication of the valve chamber 18 to the atmosphere is intercepted, while on the other hand a path is opened whereby inlet manifold vacuum present in the pipe 20 may pass through the vacuum valve chamber 18 and enter the pipe 13.

In the diagram there is also shown a "throttle positioner," which comprises a link 22 fitted to rotate loosely around the primary throttle shaft 2, and a screw 21 mounted to a lug on the link 3 so that its tip abuts against a projecting lug on the link 22. The end of the link 22 is linked, via a rod 23, to the diaphragm of a second diaphragm means 24. The means of 21, 22, 23, and 24 forms no part of the present invention, and, since the operation of the throttle positioner is well known in the art, detailed explanation of this is omitted.

25 designates the distributor of the engine, and it is fitted with a double vacuum-operated ignition timing angle advancing mechanism, in which ignition timing angle advance is provided as a combination of the functions of the normal vacuum ignition timing angle main advancer 26 and the additional ignition timing angle subadvancer 27. The main advancer 26 is supplied, via the conduit 28, with vacuum for vacuum ignition timing angle advance from an advancer port of the normal kind incorporated in the carburetor in the usual way.

Subadvancer 27, through conduit 29 and electromagnetic valve 30, is supplied with either atmospheric pressure or manifold vacuum. When subadvancer 27 is supplied with manifold vacuum it provides increase of ignition advance angle; when, on the other hand, it is supplied with air at atmospheric pressure, it does not provide increase of ignition timing advance angle, and thus the engine operates in a somewhat retarded ignition setting condition. The electromagnetic valve 30 controls switching over of supply of fluid pressure to subadvancer 27.

In more detail, electromagnetic valve 30 comprises a solenoid 31, a valve element 32, a compression coil spring 33, a valve chamber 34, and an air filter 36, and is connected to a pipe 35 which is connected to a low pressure source, conveniently the inlet manifold. When electricity is not supplied to the solenoid 31, the valve element 32 is urged upward in the figure under the effect of the compression coil spring 33, as shown in the figure. Thereby manifold vacuum from the pipe 35 is allowed to pass through the valve chamber 34 and enter the pipe 29 and the subadvancer 27 while also communication of valve chamber 34 to air at atmospheric pressure is intercepted by valve element 32. When, on the other hand, solenoid 31 is supplied with electricity, then the valve element 32 is pulled downwards in the figure against the resisting force of the compression coil spring 33, and communication of the valve chamber 34 to the pipe 35, and thus supply of manifold vacuum to valve chamber 34, is intercepted; while also a path is opened whereby air at atmospheric pressure may pass through air filter 36 and enter valve chamber 34, pipe 29, and subadvancer 37.

There is provided a control circuit which controls the operation of the two electromagnetic valves 14 and 30, as illustrated in the drawing. This circuit comprises a switch 39 which is closed when the air conditioner is operating, a switch 40 which is closed when the heater is operating, a diode 43 (which may most properly be regarded as associated with switch 40), a switch 38 which is closed when the ignition of the vehicle is switched on, and the battery of the vehicle 37.

Briefly, this circuit is adapted, in view of the provision of the diode 43, to provide both "idle-up" and ignition retardation when the heater is operating, but only "idle-up" when the air conditioner is operating.

In more detail, in the case that the air conditioner is operating and the heater is not operating, switch 39 is closed and switch 40 is open, and electricity is supplied to solenoid 15 of electromagnetic valve 14, but not to solenoid 31 of electromagnetic valve 30. When electricity is supplied to solenoid 15 of electromagnetic valve 14, as outlined above, inlet manifold vacuum is supplied to the diaphragm chamber of diaphragm means 12, and therefore, as also outlined above, idling engine speed is increased by the raising of screw 7. Therefore, in this case, the air conditioner operation "idle-up" is obtained. however, when no electricity is supplied to solenoid 31 of electromagnetic valve 30, as outlined above, manifold vacuum is supplied to subadvancer 27, and hence that engine idling timing is maintained at the more advanced setting which provides the good output power needed to operate the air conditioner.

When, on the other hand, the heater is operating, switch 40 is closed, and electricity is supplied not only to solenoid 31 of electromagnetic valve 30, but also, via diode 43, to solenoid 15 of electromagnetic valve 14. Therefore, as outlined above, supply of electricity to solenoid 15 of electromagnetic valve 14 provides "idle-up" operation and the engine idle setting is increased; and supply of electricity to solenoid 31 of electromagnetic valve 30 provides atmospheric pressure to subadvancer 27, which, therefore, does not provide increase of idling timing advance angle, and the engine will idle with a somewhat retarded timing. The effect of this is that, as suggested above, actual engine idling revolution speed will be kept at a low level, but idling fuel consumption will be increased so as to supply more heat to the cooling water of the engine so as to keep the heater working more effectively than otherwise.

In conclusion, therefore, it is seen that the present invention provides a system whereby increase of the idling opening of the throttle valve is provided whenever either the heater or the air conditioner is operating, and wherein fully advanced ignition timing in idling is provided when the air conditioner is operating, but not when the heater is operating.

Thus, when the air conditioner is being operated, an increased idling setting is provided so as to cause the engine to develop more power desired for handling the extra load imposed on it by the compressor of the air conditioner. On the other hand, when the heater is being operated, the increased idling setting is provided so as to cause the engine to develop more heat desired for keeping the engine cooling water warmer, while keeping the idling revolution speed of the engine at a reasonably low level so as not to cause harmful effects of the sort outlined above. When, however, neither the heater nor the air conditioner is being operated, the idling speed of the engine is left at a lower level, no "idle-up" being provided, thus minimizing fuel consumption and also minimizing emission of harmful exhaust gas components. The beneficial results of this invention are thus fully apparent.

In the embodiment shown in the drawing the invention is shown as fitted to a vehicle which has both a heater and an air conditioner. However, in its most general form, the device of the present invention can be fitted to any vehicle which is equipped with a heater. The fact of the existence of an air conditioner as fitted to the vehicle is not necessary to the present invention, although, if it is the case, it presents a convenient and simple combination of functions to combine the two "idle-up" functions. In the case of a vehicle equipped with only a heater, it is, of course, only necessary to provide the switch 40, not the switch 39 or diode 43. In this case, the simple function of the present invention is to provide an "idle-up" device and also an ignition-timing-alterating device which both operate when the heater is operating.

As an alternative embodiment, one could provide the switch 39 as a limit switch which may be connected to a proper part of the air conditioning control system so as to disconnect the operation of the present "idle-up" device when the air conditioning is only set at a low setting, and is drawing only an inconsiderable amount of power from the engine and thus does not require any increase of the idle setting. From the point of view of increasing fuel economy and decreasing emission of harmful exhaust gas components, this system is still more efficient.

As a further alternative embodiment, the switch 40 could be provided as a limit switch which may be connected to a proper part of the heater control system so as to connect the operation of the present "idle-up" device and "ignition-retarding" device only when the heater is set higher than a certain predetermined setting. This also would save still more fuel, and avoid still more air pollution, since when the heater is set at a low level obviously very powerful operation is not desired.

Yet another possibility would be to provide the switch 40 as one of the above possibilities, with additionally a thermostat switch in series which is only closed when the temperature of the water in the radiator upper tank, or alternatively the entrance of the heater, or alternatively the temperature of atmospheric air, is lower than some certain predetermined temperature. The workings and the effects of such a system can be easily imagined, according to the aforegiven explanations.

The present invention can be easily fitted to an existing automobile which has a conventional "idle-up" device which functions when the air conditioner is functioning, by adding to the present control switch corresponding to switch 39 in the figure another control switch such as 40 in the figure which is connected with the heater and is closed when the heater is operating, a diode such as 43, and an electromagnetic valve such as 30 and a subadvancer such as 27. This is easily done. Thus, it can be seen that the present invention can be easily adapted to present automobiles and present automobile designs.

It will be clear to those skilled in the art that various changes and omissions to the form and content of the invention as described with reference to a preferred embodiment thereof may be made, and for that reason the invention is not to be considered as limited by any particular features of that particular embodiment or of the drawing, but only by the following claims.

We claim:

1. In a vehicle which comprises an internal combustion engine having a throttle positioner for selectively setting the engine's minimum idle rate, mechanical means for automatically increasing said idle rate above said minimum in response to certain engine conditions, and a vacuum advancer having first and second vacuum supply ports and being adapted to provide normal vacuum advance of ignition timing when said first and second ports are supplied with engine inlet manifold vacuum and to provide reduced vacuum advance of ignition timing when said first port is supplied with inlet manifold vacuum and said second port is supplied with atmospheric pressure, and having a heater for providing engine-generated heat to the vehicle during operation and an air conditioner adapted to be driven by the engine, a control system, comprising:

(a) first means for controlling said throttle positioner to automatically increase said minimum idle rate setting between a low setting and a high setting;

(b) second means for indicating operational condition of said heater;

(c) third means for controlling alternative supply of said manifold vacuum and atmospheric pressure to said second port of said vacuum advancer;

(d) fourth means for indicating operational condition of said air conditioner;

(e) said second and fourth means controlling said first means to maintain said minimum idle rate of said low setting when neither said heater nor said air conditioner is operating and to increase said minimum idle rate to said high setting when either said heater or said air conditioner is operating; and (f) said second means controlling said third means so as to supply atmospheric pressure to the second port of said vacuum advancer when said heater is operating and so as to supply said manifold vacuum to said second port during operating conditions of the engine when said heater is not operating.

2. The control system as in claim 1 wherein said first means comprises a throttle stop, a diaphragm actuator which shifts said throttle stop in the direction to increase the minimum idle rate of said engine to said high setting when said diaphragm actuator is supplied with vacuum, a first electromagnetic control valve which changes over supply of fluid pressure to said diaphragm actuator between inlet manifold vacuum of the engine and atmospheric pressure, and a first control circuit which supplies electricity to said first electromagnetic control valve to actuate it; wherein said third means comprises a second electromagnetic control valve which changes over supply of fluid pressure to the second port of said vacuum advancer between atmospheric pressure and inlet manifold vacuum of the engine, and a second control circuit which supplies electricity to said second electromagnetic control valve to actuate it; wherein said second means comprises a first electric switch which opens or completes said first and second control circuits according to the operational condition of said heater; and wherein said fourth means comprises a second electric switch which opens or completes said first control circuit according to the operational condition of said air conditioner.

3. The control system as in claim 2 wherein said first electromagnetic control valve provides inlet manifold vacuum of the engine to said diaphragm actuator when energized, wherein said second electromagnetic control valve provides inlet manifold vacuum of the engine to the second port of said vacuum advancer when not energized, wherein said first switch is closed completing said first and second control circuits only when the heater is operating, wherein said second switch is closed completing said first control circuit only when the air conditioner is operating, and wherein a diode is provided so as to prevent said second electromagnetic control valve from being energized when only said second switch is closed.

* * * * *